United States Patent [19]

Buckman et al.

[11] Patent Number: 5,058,832

[45] Date of Patent: Oct. 22, 1991

[54] PARACHUTE TRIGGER MECHANISM

[76] Inventors: Kevin J. Buckman, 5937 Cumberland Pl., Stockton, Calif. 95209; Thomas P. Buckman, 14093 Glenn Pines Rd., Grass Valley, Calif. 95945

[21] Appl. No.: 651,942

[22] Filed: Feb. 7, 1991

[51] Int. Cl.[5] ..... B64C 31/06

[52] U.S. Cl. ..... 244/155 R

[58] Field of Search ..... 244/153 R, 155 R, 155 A; 104/113; 294/66.1; 114/270

[56] References Cited

U.S. PATENT DOCUMENTS

| | | | |
|---|---|---|---|
| 2,944,775 | 7/1960 | Selleck | 244/155 R |
| 2,983,471 | 5/1961 | Melvin | 244/155 R |
| 3,114,334 | 12/1963 | Kahl | 244/155 R |
| 3,119,584 | 1/1964 | Kimbel | 244/155 R |
| 3,482,807 | 12/1969 | Morris | 244/155 R |
| 4,465,251 | 8/1984 | Newbold | 244/155 R |

FOREIGN PATENT DOCUMENTS

| | | | |
|---|---|---|---|
| 590621 | 7/1947 | United Kingdom | 244/155 R |

*Primary Examiner*—Galen Barefoot

*Attorney, Agent, or Firm*—Witherspoon & Hargest

[57] ABSTRACT

A trigger mechanism for an aerial device including a unitary housing having three longitudinal bores extending therethrough and a spring biased rod or wire-like mechanism which includes a plurality of bends forming various portions which can be inserted into such bores after such rod has been bent and a spring has been attached to such rod.

23 Claims, 2 Drawing Sheets

PARACHUTE TRIGGER MECHANISM

BACKGROUND OF THE INVENTION

1. Field of the Invention

The present invention relates to a trigger mechanism for use with an object such as a toy parachute having a doll extending therefrom which can be transported along an elevated kite string and automatically released at a predetermined height.

2. Description of the Prior Art

It is known to provide a toy parachute release device for use with a kite. For example, U.S. Pat. No. 3,482,807 to Morris describes such a device wherein a kite string and actuating wire extend through a body allowing the body to travel along the kite string and release a parachute at a selected location along the string when an abutment ring engages a stationary abutment. A patent of similar interest is U.S. Pat. No. 2,944,775 to Selleck.

Other U.S. patents which describe toy parachute release devices include the following:

| | |
|---|---|
| 620,596 | Lower |
| 764,749 | Moravek |
| 985,301 | Terry |
| 4,074,877 | Hayenga |
| 4,240,600 | Urasaki |

Notwithstanding the existence of the foregoing patents it is believed that there is a need for a trigger mechanism which is simple and inexpensive to manufacture, can be readily assembled and can be positioned upon a kite string while the kite is being flown or beforehand. It is also desirable to provide such a simplified trigger mechanism to which a parachute-type toy can be easily attached which includes a spring-biased automatic retracting mechanism for positively holding the parachute assembly in place until it is released as desired. It is further desirable to provide such a trigger mechanism which can be fabricated using standard wire bending and injection mold tooling. It is also desirable to provide such a trigger device wherein a release wire or rod containing a plurality of bends can be bent as desired and have a spring means attached thereto prior to its final assembly with a support housing. It is further desirable to provide such a trigger device wherein such release wire or rod can be snap fitted into its support housing and thereby locked therein during use and yet be removable from such housing if desired. It is also desirable to provide such a trigger mechanism wherein the spring means is recessed into the housing to increase the reliability of the flight of the parachute, facilitate assembly of the trigger mechanism to the kite string, and prevent inadvertent misalignment of the trigger mechanism vis-a-vis the kite string stop member. It is also desirable to provide such a trigger mechanism which is relatively compact and light thereby facilitating use in light winds or with a less efficient kite.

SUMMARY OF THE INVENTION

This invention achieves these and other results by providing a trigger mechanism for an aerial device comprising a housing which includes an upper bore extending therethrough along a first axis for attachment of the housing to a kite string, a lower bore extending into the housing along a second axis, and a central bore positioned between the upper and lower bore and extending through the housing along a third axis. The first, second and third axes are parallel to each other. A first slot extends through the housing to the upper bore, the first slot extending from one end of the housing to an opposite second end of the housing. A second slot extends through the housing to the central bore, the second slot extending from the one end to the opposite second end of the housing. A third slot extends through the housing to the lower bore, the third slot extending from the one end toward the opposite second end of the housing. A fourth slot extending through the housing to the lower bore, the fourth slot being aligned with the third slot. A rod is provided having a first portion which extends through the central bore. A second portion is provided which is parallel to the first portion and extends into the lower bore from the one end of the housing and into the fourth slot. The second portion is oriented for movement through the third slot. The second portion is bridged to the first portion at a first end of the first portion by a third portion, and a fourth portion extends from an opposite second end of the first portion and includes means for attachment of the rod to the line. Spring means is provided for urging the fourth portion away from the housing and for urging the second portion into the lower bore.

The present invention also includes a trigger mechanism as described herein in combination with an object which can be transported along an elevated kite string.

BRIEF DESCRIPTION OF THE DRAWINGS

This invention can be clearly understood by reference to the attached drawings in which.

DESCRIPTION OF THE PREFERRED EMBODIMENT

Figure 1:
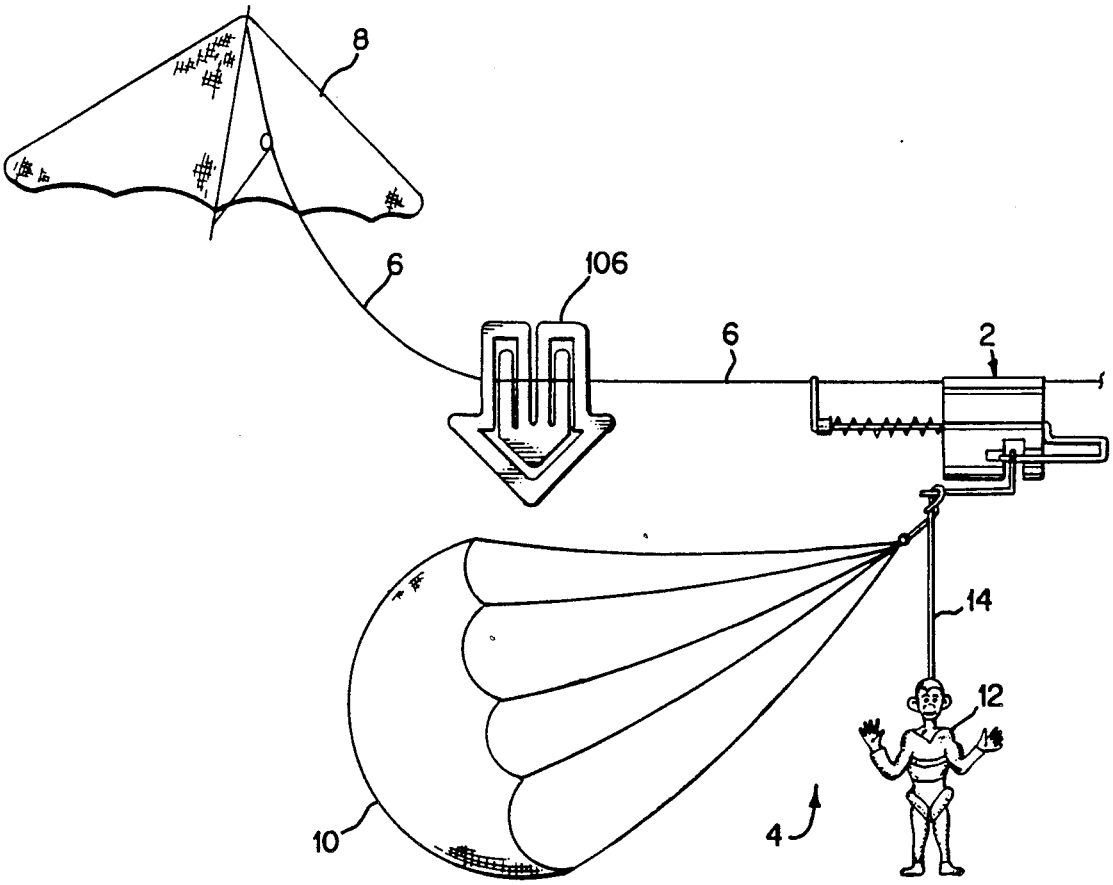
FIG. 1 is a view of one embodiment of the present invention.

The embodiment of this invention which is illustrated in FIGS. 1 to 4 is particularly suited for achieving the objects of this invention. FIG. 1 depicts the trigger mechanism 2 of the present invention in combination with an object 4 which can be transported along an elevated kite string 6 attached to a kite 8. The object 4 can include a parachute 10 having a doll 12 suspended therefrom by string 14, the object 4 being attached to the trigger mechanism 2 as described herein.

Figure 4:
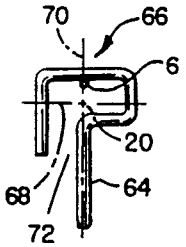
FIG. 4 is a partial opposite end view of the trigger mechanism of FIG. 2.
Figure 2:
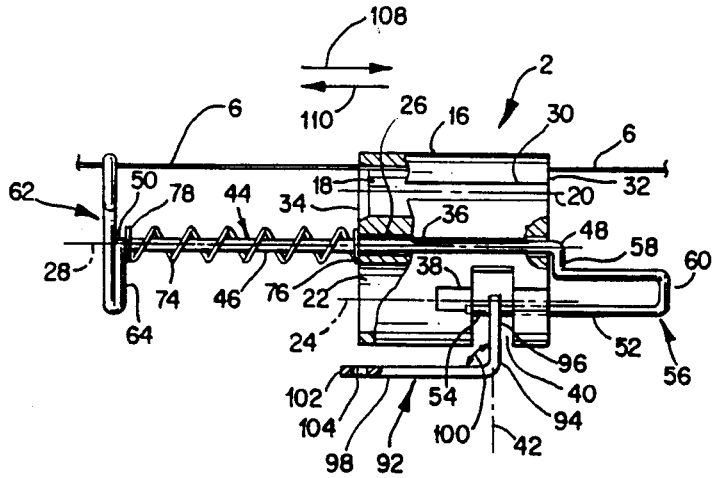
FIG. 2 is an elevational view of the trigger mechanism depicted in FIG. 1.
Figure 3:
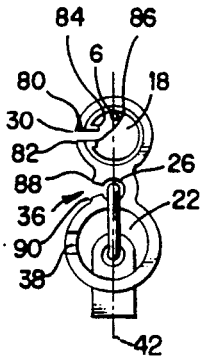
FIG. 3 is an end view of the trigger mechanism of FIG. 2.

FIGS. 2 to 4 are enlarged views of the trigger mechanism 2 of FIG. 1. Trigger mechanism 2 includes a housing 16 which comprises an upper bore 18 extending through the housing along a first axis 20 for attachment of the housing 16 to kite string 6 which extends through bore 18. Housing 16 also includes a lower bore 22 extending into the housing along a second axis 24. Although not necessary, in the embodiment of FIG. 2 the lower bore extends through the housing 16. Housing 16 also includes a central bore 26 positioned between upper bore 18 and lower bore 22 which extends through the housing along a third axis 28. The first axis 20, second axis 24 and third axis 28 are parallel to each other. A first slot 30 extends through the wall of the housing 16 to the upper bore 18, such first slot extending along the length of the housing from one end 32 of the housing to an opposite second end 34 of the housing. A second slot 36 extends through the wall of the housing 16 to the central bore 26, such second slot extending along the length of the housing from end 32 to end 34. A third slot 38 extends through the wall of the housing 16 to the lower bore 22, such third slot extending partially along the length of the housing from end 32 toward end 34. If desired, although not necessary, the third slot 38 can extend along the full length of the housing. A fourth slot 40 is also provided. Fourth slot 40 extends through the wall of the housing 16 to the bore 22. Such fourth slot generally extends radially along axis 42 and is aligned with the third slot 38 such that axis 42 is at an angle of 90° relative to axis 24.

A rod 44 is associated with the housing 16. In the embodiment depicted in the drawings the rod is in the form of a wire having multiple bends as described herein. Rod 44 includes a first portion 46 which extends through the central bore 26. Rod portion 46 includes a first end 48 and an opposite second end 50. Rod 44 also includes a second portion 52 which is parallel to the first portion 46 and extends into the lower bore 22 from end 32 of the housing toward end 34 of the housing. The first and second portions of rod 44 are free to reciprocate within the central bore and lower bore, respectively, as described herein. The second portion extends far enough into lower bore 22 that a length 54 of the second portion 52 extends into the second slot 40 as depicted in FIG. 2. Although not necessary, attachment of the object 4 to the trigger mechanism 2 can be facilitated by bending rod 44 such that length 54 is below the centerline of bore 22 as depicted in FIG. 2. Such second portion 52 is oriented for rotational movement through the third slot 38 as described herein. The second portion 52 is bridged with the first portion 46 at end 32 of the housing by a third portion 56. In the preferred embodiment, end 48 of the first portion 46 is adjacent a shoulder 58 which extends from end 48 for engagement with end 32 of the housing 16 as depicted in FIG. 2. In such embodiment, the third portion 56 is in the form of a handle 60 which extends away from end 32 of the housing. Handle 60 extends from second portion 52 and from shoulder 58 as depicted in FIG. 2.

The rod 44 also includes a fourth portion 62 extending from the opposite second end 50 of the first portion 46. The fourth portion 62 includes means for attachment of the rod 44 to the kite string 6. For example, in the preferred embodiment of FIG. 2 such attachment means includes an extension 64 of the fourth portion 62 wherein the rod is bent to form a plurality of legs which collectively have a rectangular-like configuration 66 which lies in a plane defined by coordinates 68, 70, such plane being normal to the first axis 20 as depicted in FIGS. 2 and 4. Such rectangular-like configuration 66 is of a length in the direction of coordinate 68 which is greater than the length in the direction of coordinate 70 to prevent entanglement of the rod with the loops on the stop member 106 of the type depicted in FIG. 1. The rod is bent in such a manner as to provide a gap at 72 through which the kite string 6 can pass such that the attachment means can be hung from the kite string as depicted in FIG. 4.

Trigger mechanism 2 also includes a spring means for urging the fourth portion 62 away from end 34 of housing 16 and for urging the second portion 52 into the lower bore 22. In the preferred embodiment such spring means is a compression spring in the form of a helical spring 74 having one end 76 which abuts against end 34 of housing 16 and an opposite end 78 which abuts the fourth portion 62. Spring 74 is a weak spring of about 0.7 pounds per inch yet is strong enough to prevent inadvertent withdrawal of the end of length 54 from slot 40 and inadvertent rotational movement of the length 54 of the second portion 52 through slot 38.

In the preferred embodiment the first slot 30 is formed by opposing surfaces 80, 82 each of which includes a flange 84, 86, respectively, which extends into the upper bore 18. In the embodiment of FIGS. 1 to 4, flanges 84, 86 extend from end 32 to end 34 of housing 16. Such flanges will keep the kite string from inadvertent removal during use of the trigger mechanism a described herein but will not inhibit removal of the trigger mechanism from the kite string for storage. The second slot 36 can be formed by opposing surfaces 88, 90. Preferably, the distance between surfaces 80, 82 is close to the diameter of the kite string 6 and the distance between surfaces 88, 90 is less than the diameter of rod portion 46, the housing being fabricated from a resilient material.

The housing 16 can be manufactured in any known manner. For example, housing 16 can be fabricated by injection molding or extruding a resilient material such as polyvinyl chloride, polyethylene, acetal nylon, and the like to form the multi-tubular structure depicted in FIGS. 2 and 3. Bores 18, 22 and 26 and slots 30, 36, 38 and 40 can be provided for during the injection mold or extrusion process. The rod 44 can be bent in a known manner with the spring 74 attached thereto. The rod can then be positioned within the housing 16 such that rod portion 46 extends through bore 36 and rod portion 52 extends into bore 22, the spring 74 being disposed between end 34 and fourth portion 62. To this end rod portion 46 can be radially inserted into bore 26 through slot 36 and rod portion 52 can be radially inserted into bore 22 through slot 38. By providing a housing fabricated from a resilient material wherein surfaces 88, 90 are spaced from each other a distance less than the diameter of the rod portion 46, rod portion 46 can be snap-fitted into bore 26 so that rod portion 46 will not fall out of housing 16 during use of the trigger mechanism 2.

In use, the trigger mechanism 2 is first attached to kite string 6 by radially inserting the kite string through slot 30 and into bore 18 and also inserting the kite string through gap 72 such that the trigger mechanism is supported at one end by the fourth portion 62 and at the opposite end by housing 16. In the embodiment of FIGS. 1 to 4, the parachute 10 and doll 12 are attached to a connecting means 92 for releasably connecting the parachute and doll to the trigger mechanism 2. In the embodiment of FIG. 2, the connecting means 92 includes a first leg 94 having an aperture 96 therethrough at one end of the first leg 94. As depicted in FIG. 2, second leg 98 extends toward the fourth portion 62 from the first leg 94 at an angle 100 of about 90° relative to the first leg. In the embodiment of FIG. 2, the second leg 98 extends from the first leg 94 at an end opposite the apertured end of leg 94. The bend at angle 100 facilitates a fail-free disconnection of the connecting means 92 from the housing 16 during actuation of the trigger mechanism. The parachute and doll are attached to the distal end 102 of the second leg 98 by string 14 which extends through an aperture 104 which extends through the second leg, the string 14 being knotted to such distal end as depicted in FIG. 1. In order to attach the object 4 to the trigger mechanism, the handle 60 is grasped and pivoted about axis 28 s that the length 54 of the second portion 52 is caused to retract from bore 22 through slot 38. The first leg 94 is connected to the trigger mechanism by inserting length 54 of the second portion 52 of rod 44 through the aperture 96. Finally, the handle 60 is pivoted in the opposite direction about axis 28 so that the length 54 of the second portion 52 is inserted back into bore 22 through slot 38. At the same time, the first leg 94 is thereby caused to be inserted into bore 22 through slot 38 such that the leg 94 is suspended by the length 54 and is caused to hang vertically downward through slot 40 as depicted in FIGS. 2 and 3. Slot 40, to facilitate ease of attachment of connecting means 92, is at least four times the width of the first leg 94.

In operation, the wind advances the parachute 10 up the kite string 6 toward the kite 8. During such ascent, the parachute pulls the trigger mechanism along the kite string. Such ascent continues until the fourth portion 62 contacts a stop member 106 which has previously been fastened to the kite string at a predetermined location. When the fourth portion 62 contacts the stop member 106 there will be sufficient force for the spring 74 to be compressed between the fourth portion 62 and the end 34 of housing 16 and for the rod portions 46 and 52 to slide relative to bores 36 and 38, respectively, in the direction of arrow 108 such that the length 54 will be retracted from aperture 96 allowing the first leg 94 to be dropped by the trigger mechanism 2 as such first leg falls from slot 40 under the force of gravity. Parachute 10 and doll 12 will float to the ground and the trigger mechanism 2 will slide toward the ground along kite string 6. Subsequent to the release of the object 4, spring 74 will expand under its own force causing rod portions 46 and 54 to slide relative to bores 36 and 38, respectively, in the direction of arrow 110 such that the length 54 will once again be fully inserted into bore 22.

FIGS. 5 to 9 are enlarged views of an alternate trigger mechanism 2'. Such trigger mechanism 2, can be fabricated in the same manner as trigger mechanism 2 with the alterations noted below. In particular, a trigger mechanism 2' includes a housing 16' which comprises an upper bore 18' extending through the housing along a first axis 20' for attachment of the housing 16' to kite string 6 which extends through bore 18'. Housing 16' also includes a lower bore 22' extending into the housing along a second axis 24'. Housing 16' also includes a central bore 26' positioned between upper bore 18' and lower bore 22' which extends through the housing along third third axis 28'. The first axis 20', second axis 24' and third axis 28' are parallel to each other. A first slot 30' extends through the wall of the housing 16' to the upper bore 18', such first slot extending along the length of the housing from one end 32' of the housing to an opposite second end 34' of the housing. A second slot 36' extends through the wall of the housing 16' to the central bore 26', such second slot extending along the length of the housing from end 32' to end 34'. A third slot 38' extends through the wall of the housing 16' to the lower bore 22', such third slot extending partially along the length of the housing from end 32' toward end 34'. If desired, although not necessary, the third slot 38' can extend along the full length of the housing. A fourth slot 40' is also provided. Fourth slot 40' extends through the wall of the housing 16' to bore 22'. Such fourth slot generally extends radially along axis 42' and is aligned with the third slot 38'.

Figure 5:
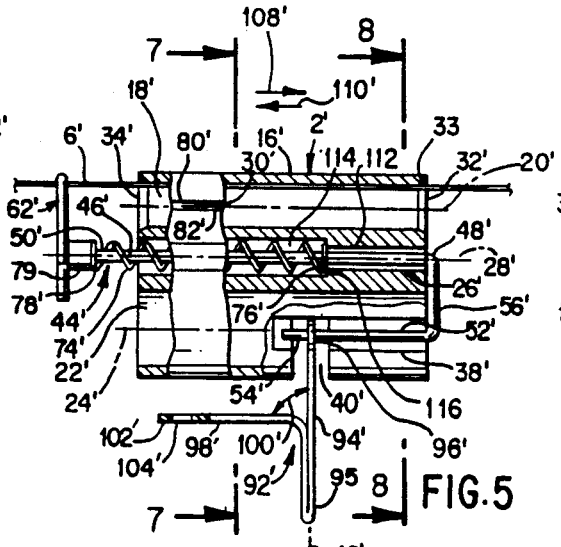
FIG. 5 is an elevational view of an alternate trigger mechanism of the present invention.

A rod 44' is associated with housing 16'. In the embodiment depicted in the drawings the rod is in the form of a wire having multiple bends as indicated herein. Rod 44' includes a first portion 46' which extends through the central bore 26'. Rod portion 46' includes a first end 48' and an opposite second end 50'. Rod 44' also includes a second portion 52' which is parallel to the first portion 46', and extends into the lower bore 22' from end 32' of the housing toward end 34' of the housing. The second portion extends far enough into lower bore 22' that a length 54' of the second portion 52' extends into the second slot 40' as depicted in FIG. 5. Such second portion 52' is oriented for movement through the third slot 38' as described herein. The second portion 52' is bridged with the first portion 46' at end 32' of the housing by a third portion 56' which is in the form of a shoulder for engagement with end 32' of the housing 16' as depicted in FIG. 5.

Figure 9:
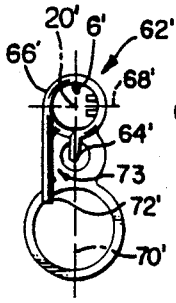
FIG. 9 is an end view of the trigger mechanism of FIG. 5.

The rod 44' also includes a fourth portion 62' extending from the opposite second end 50' of the first portion 46'. The fourth portion 62' includes means for attachment of the rod 44' to the kite string 6. For example, in the preferred embodiment of FIG. 5 such attachment means includes an extension 64' of the fourth portion 62' wherein the rod is bent to form a plurality of legs which collectively have a round-like configuration 66' which lies in a plane defined by coordinates 68', 70', such plane being normal to the first axis 20' as depicted in FIGS. 5 and 9. The rod is bent in such a manner that one leg thereof 72' is parallel to extension 64'. Due to the flexibility of the rod 44' the kite string 6 can be moved up through area 73 such that the attachment means can be hung from the kite string as depicted in FIG. 9.

An alternative method to prevent the spring from migrating on wire segment 62' as depicted in FIGS. 5 and 9 is to provide tubular member 79 on first portion 46'. Said tubular member has an outside diameter greater than the outside diameter of the spring and an inside diameter of approximately 0.005 greater than first portion 46'.

In the preferred embodiment the first slot 30' is formed by opposing surfaces 80', 82' each of which includes a flange 84', 86', respectfully, which extends into the upper bore 18'. Flanges 84', 86' can extend from end 32' to end 34' of housing 16'. Preferably, the distance between surfaces 80', 82' is slightly greater than the diameter of kite string 6 and the housing is fabricated from a resilient material.

In the embodiment of FIGS. 5 to 9 the central bore 26' includes a first length 112 which extends into housing 16' from housing end 32' and a second length 114 which extends into housing 16' from housing end 34'. The second length has a diameter which is greater than the diameter of the first length to form a shoulder 116 where the length 114 meets the length 112. Spring means is provided in the form of a helical spring 74' which is disposed within the second length 114 such that one end 76' abuts against shoulder 116 and an opposite end 78' abuts against the fourth portion 62'. By positioning the spring within the second length 114 it is possible to reduce the distance between the fourth portion 62' and the end 34' of the housing 16'. Such a reduction in distance relative to the embodiment of FIG. 1 allows a child's hand to more easily operate the device as described herein.

The second slot 36' includes first opposing surfaces 118, 120 adjacent the first length 112 and second opposing surfaces 122, 124 adjacent the second length 114. The first opposing surfaces 118, 120 are spaced from each other a distance less than the diameter of the rod 44' and the second opposing surfaces 122, 124 are spaced from each other a distance less than the diameter d of the helical spring 74'.

Third slot 38' can be formed by opposing surfaces 126, 128 which are spaced from each other a distance that enables rotation of first portion 46' in bore 26' such that second portion 52' can be moved into slot 38' after attachment of first leg 94'.

Figure 7:
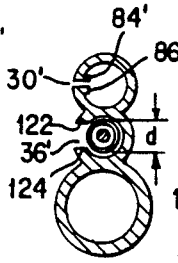
FIG. 7 is a view taken along line 7—7 of FIG. 5.
Figure 8:
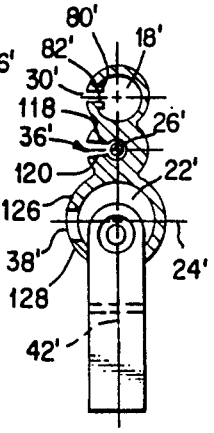
FIG. 8 is a view taken along line 8—8 of FIG. 5.
Figure 6:
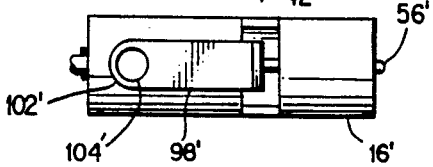
FIG. 6 is a bottom view of the trigger mechanism of FIG. 5.

One or more of the slots 30', 36' and 38' can be formed by opposing surfaces which are tapered toward each other from the exterior of housing 16' to an upper, central and lower bore, respectively. Such taper is best depicted in FIGS. 7 and 8. Similar tapering can be provided for the opposing surfaces of the slots 30 and 36 of the embodiment of FIGS. 2 to 4, if desired.

Bore 18' is chamfered or radiased 33 at both ends as depicted in FIG. 5 to provide ease of passage of kite string 6. A similar chamfered or radiased structure can be provided at both ends of bore 18 of the embodiment of FIGS. 2 to 4.

In assembling the trigger mechanism 2', rod 44' is positioned within housing 16' such that rod portion 46' extends through bore 36' and rod portion 52' extends into bore 22', the spring 74' being partially disposed within the second length 114 such that the spring extends from shoulder 116 to the fourth portion 62'. To this end rod portion 46' can be radially inserted into bore 26' through slot 36' at first length 112 and second length 114, and spring 74' can be radially inserted into bore 26' through slot 36' at second length 114. By spacing opposing surfaces 118, 120 and opposing surfaces 122, 124 as described herein, rod portion 46' can be snap-fitted into bore 26' at first length 112 and spring 74' can be snap-fitted into bore 26' at second length 114 so that the rod portion and spring will not fall out of the housing 16' during use of the trigger mechanism 2'.

In use, the trigger mechanism 2' operates in the same manner as the embodiment of FIGS. 2 to 4 except as described herein. One distinction already discussed is the manner in which the fourth portion 62' is attached to the kite string 6. Another distinction is the manner in which the object 4 is attached to the housing 16'. In particular, a connecting means 92' provided including a first leg 94' having an aperture 96' therethrough at one end of the leg 94'. A second leg 98' extends toward fourth portion 62' from the first leg 94' at an angle of 100' of about 90° relative to the first leg. An extension 95 provides a convenient handle. The second leg 98' prevents wedging of the connecting means 92' when the fourth portion 62' engages the stop member 106. The parachute and doll are attached to the distal end 102' of leg 98' by string 14 which can be caused to extend through an aperture 104' which extends through the second leg, the string being knotted to distal end 102'. In order to attach the object 4 to the trigger mechanism, the fourth portion 62' and housing end 32' are squeezed between the thumb and forefinger thereby compressing the spring 74' and causing length 54' to move in the direction of arrow 108' out of the slot 40'. Subsequently, the first leg 94' is inserted into slot 40' and the fourth portion is released allowing the spring 74' to expand under its own force causing the length 54' to slide relative to bore 22' in the direction of arrow 110' such that length 54' can be caused to extend through aperture 96' of first leg 94' to support the object 4.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

We claim:

1. A trigger mechanism for an aerial device, comprising:

a housing comprising an upper bore extending therethrough along a first axis for attachment of said housing to a kite string; a lower bore extending into said housing along a second axis, and a central bore positioned between said upper and lower bore and extending through said housing along a third axis, said first, second and third axes being parallel to each other, a first slot extending through said housing to said upper bore, said first slot extending from one end of said housing to an opposite second end of said housing, a second slot extending through said housing to said central bore, said second slot extending from said one end to said opposite second end, a third slot extending through said housing to said lower bore, said third slot extending from said one end toward said opposite second end, and a fourth slot extending through said housing to said lower bore, said fourth slot being aligned with said third slot;

a rod having a first portion which extends through said central bore, a second portion which is parallel to said first portion and which extends into said lower bore from said one end and into said fourth slot, said first and second portions being free to reciprocate within said central bore and said lower bore, respectively, said second portion being oriented for rotational movement through said third slot, said second portion being bridged to said first portion at a first end of said first portion by a third portion, and a fourth portion extending from an opposite second end of said first portion and including means for attachment of said rod to said line; and spring means for urging said fourth portion away from said housing and for urging said second portion into said lower bore.

2. The trigger mechanism of claim 1 wherein said spring means is a compression spring having one end which abuts against said opposite second end of said housing and an opposite end which abuts against said fourth portion, said compression spring being of sufficient force to prevent inadvertent rotational movement of said second portion through said third slot and prevent inadvertent lateral movement of said rod as said trigger mechanism proceeds up the kite string whereby said lateral movement could result in premature release of said aerial device.

3. The trigger mechanism of claim 2 wherein said first portion is adjacent a shoulder extending from said first end of said first portion for engagement with said one end of said housing, and wherein said third portion is in the form of a handle which extends away from said one end of said housing, said handle extending from said second portion and from said shoulder.

4. The trigger mechanism of claim 3 wherein said attachment means includes an extension of said fourth portion wherein said rod is bent to form a plurality of legs which collectively have a rectangular-like configuration which lies in a plane which is normal to said first axis.

5. The trigger mechanism of claim 4 wherein said first slot is formed by opposing surfaces each of which includes a flange extending into said upper bore.

6. The trigger mechanism of claim 5 wherein each flange extends from said one end of said housing to said opposite end of said housing.

7. The trigger mechanism of claim 6, wherein said first slot and said second slot include opposing surfaces which are spaced from each other a distance slightly greater than the diameter of said kite string and said first portion of said rod, respectfully, said housing comprising a resilient material.

8. The trigger mechanism of claim 1 , wherein said central bore includes a first length extending into said housing from said one end of said housing and a second length extending into said housing from said opposite second end of said housing, said second length having a diameter which is greater than the diameter of said first length to form a shoulder where said second length meets said first length, and further wherein said spring means is a compression spring disposed within said second length and having one end which abuts against said shoulder and an opposite end which abuts said fourth portion.

9. The trigger mechanism of claim 8 wherein said first slot is formed by opposing surfaces which are spaced from each other a distance greater than the diameter of said kite string, said housing comprising a resilient material.

10. The trigger mechanism of claim 9 wherein said second slot includes first opposing surfaces adjacent said first length and second opposing surfaces adjacent said second length, said first opposing surfaces being spaced from each other a distance less than the diameter of said rod and second opposing surfaces being spaced from each other a distance less than the diameter of said helical spring.

11. The trigger mechanism of claim 10 wherein said third slot includes opposing surfaces which are spaced from each other a distance sufficient to rotate a segment of said rod into said slot when the parallel rod segment is positioned in said central slot.

12. The trigger mechanism of claim 11 wherein said first slot is formed by opposing surfaces each of which includes a flange extending into said upper bore.

13. The trigger mechanism of claim 12, wherein each flange extends from said one end of said housing to said opposite end of said housing.

14. The trigger mechanism of claim 11, wherein at least one of said first, second and third slots is formed by opposing surfaces which are tapered toward each other from the exterior of said housing to an upper, central and lower bore, respectively.

15. The trigger mechanism of claim 14 wherein said attachment means includes an extension of said fourth portion wherein said rod is bent to form a plurality of legs which collectively have a square-like configuration which lies in a plane which is normal to said first axis.

16. The trigger mechanism of claim 1 wherein the diameter of said first bore provides a loose fit for said first portion yet maintains said second portion below said third axis.

17. A trigger mechanism in combination with an object which can be transported along an elevated kite string, the improvement comprising:

a housing comprising an upper bore extending therethrough along a first axis for attachment of said housing to a kite string; a lower bore extending into said housing along a second axis, and a central bore positioned between said upper and lower bore and extending through said housing along a third axis, said first, second and third axes being parallel to each other, a first slot extending through said housing to said upper bore, said first slot extending from one end of said housing to an opposite second end of said housing, a second slot extending through said housing to said central bore, said second slot extending from said one end to said opposite second end, a third slot extending through said housing to said lower bore said third slot extending from said one end toward said opposite second end, and a fourth slot extending through said housing to said lower bore, said fourth slot being aligned with said third slot;

a rod having a first portion which extends through said central bore, a second portion which is parallel to said first portion and which extends into said lower bore from said one end and into said fourth slot, said first and second portions being free to reciprocate within said central bore and said lower bore, respectively, said second portion being oriented for rotational movement through said third slot, said second portion being bridged to said first portion at said first end of said first portion by a third portion, and a fourth portion extending from an opposite second end of said first portion and including means for attachment of said rod to said line;

spring means for urging said fourth portion away from said housing and for urging said second portion into said lower bore; and connecting means for releasably connecting to said trigger mechanism a device to be dropped from said kite string, said connecting means including a first leg having an aperture therethrough at one end thereof, said first leg being releasably connected to said trigger mechanism by said second portion extending through said aperture.

18. The trigger mechanism of claim 17 further including second leg extending toward said fourth portion from said first leg and at an angle of about 90° relative to said first leg, said object being attached to a distal end of said second leg.

19. The trigger mechanism of claim 18 further including an extension of the first leg,said extension providing a convenient handle for holding the connecting means when attaching said means to the rod.

20. The trigger mechanism of claim 18 wherein said second leg extends from an opposite end of said first leg.

21. The trigger mechanism of claim 18 wherein said second leg extends from a mid-point of said first leg.

22. The trigger mechanism of claim 8 wherein said compression spring disposes within said second length and having one end which abuts against said shoulder and an opposite end which abuts a cylindrical member which abuts said fourth portion.

23. The trigger mechanism of claim 22 wherein said cylindrical member incorporates an outside diameter slightly greater than the outside diameter of said compression spring, the inside diameter comprises a slip fit diameter relative to the rod and the length is approximately twice the outside diameter.

* * * * *